US006523488B1

(12) United States Patent
Lee

(10) Patent No.: US 6,523,488 B1
(45) Date of Patent: Feb. 25, 2003

(54) CUTTING DEVICE FOR ELONGATED MATERIALS

(75) Inventor: John Y. Lee, Tustin, CA (US)

(73) Assignee: Orange County Industrial Sewing Machine Co., Inc., Santa Ana, CA (US)

( * ) Notice: Subject to any disclaimer, the term of this patent is extended or adjusted under 35 U.S.C. 154(b) by 0 days.

(21) Appl. No.: 09/358,779

(22) Filed: Jul. 22, 1999

(51) Int. Cl.[7] ..... D05B 37/04
(52) U.S. Cl. ..... 112/475.04; 112/128; 112/129
(58) Field of Search ..... 112/475.04, 153, 112/122, 128, 129, 130, 261; 83/13, 30, 168, 175, 188, 902, 910, 921, 936

(56) References Cited

U.S. PATENT DOCUMENTS

| | | | | | |
|---|---|---|---|---|---|
| 678,993 | A | * | 7/1901 | Bissinger | 112/128 X |
| 1,586,163 | A | * | 5/1926 | Sharaf | 112/129 X |
| 2,510,929 | A | * | 6/1950 | Ketcham | 112/128 |
| 3,169,430 | A | | 2/1965 | DeMallie et al. | |
| 3,848,555 | A | * | 11/1974 | Boser | 112/288 |
| 4,130,038 | A | | 12/1978 | Zehnder | |
| 4,196,647 | A | | 4/1980 | Fish | |
| 4,488,466 | A | | 12/1984 | Jones | |
| 4,502,400 | A | * | 3/1985 | Walther | 112/122 |
| 5,107,732 | A | | 4/1992 | Hanmer | |
| 5,377,570 | A | | 1/1995 | Giljam | |

* cited by examiner

*Primary Examiner*—Ismael Izaguirre
(74) *Attorney, Agent, or Firm*—Knobbe, Martens, Olson & Bear, LLP

(57) ABSTRACT

The cutting device comprises a first block or ram, and a second block or receptacle. The ram has a channel that extends along its longitudinal length, the channel is sized and configured to accept at least a portion of a cutting blade. The receptacle has a hollow sized and configured to accept at least a portion of the ram. The blade is arranged within the hollow and extends from the receptacle into the hollow and toward the ram. The blade is advantageously recessed within the ram. In one embodiment, the ram is attached to a drive coupled to a sewing machine, and the receptacle is attached to the sewing machine. The ram is moveable between a retracted position, in which the ram is separated from the receptacle, and an extended position, in which at least a portion of the ram is housed within the receptacle. By this configuration, elongated material may be placed between the receptacle and ram and then the ram can move from the retracted position to the extended position, whereby a portion of the elongated material is cut by the blade.

41 Claims, 6 Drawing Sheets

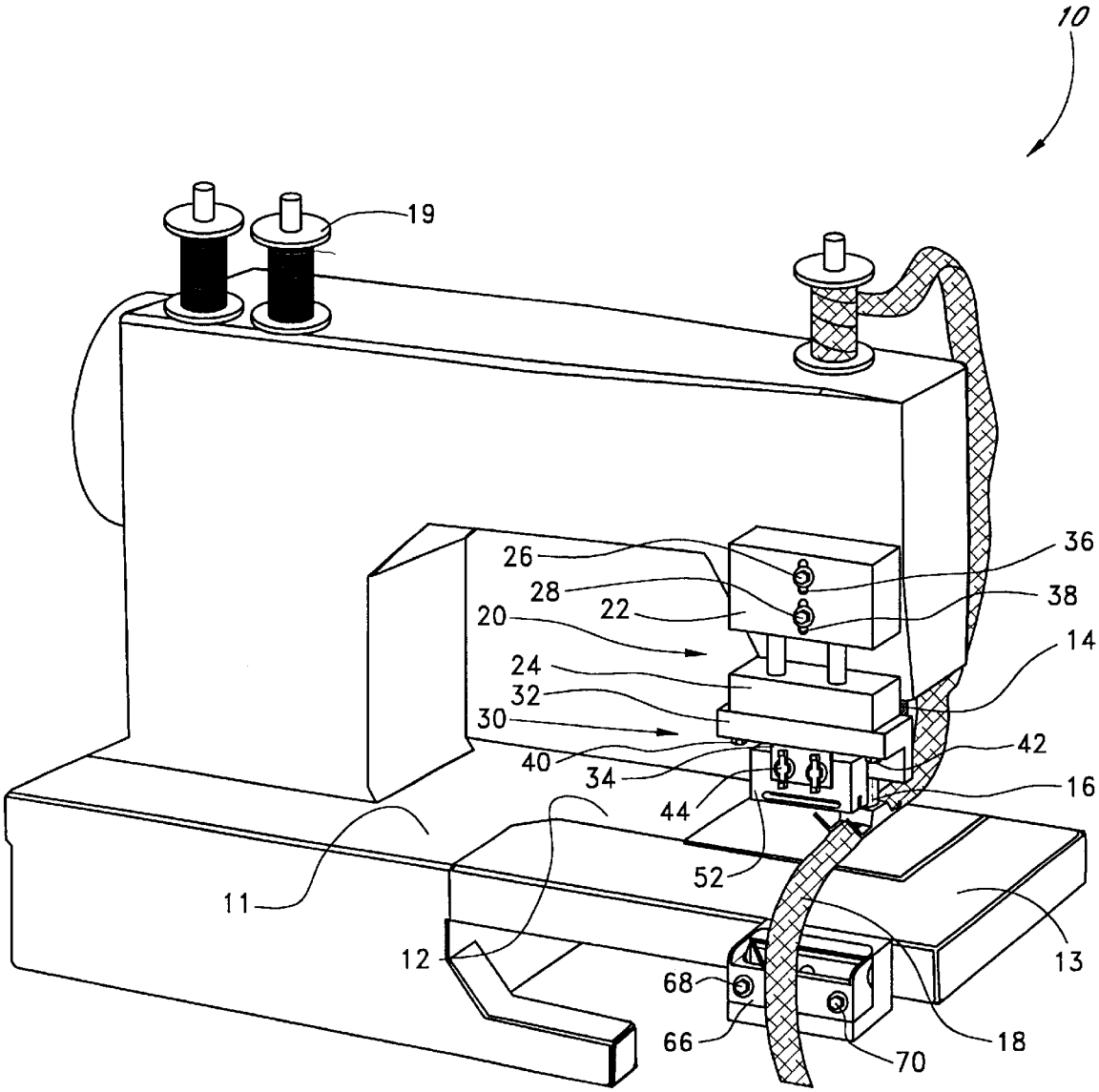
FIG. 1
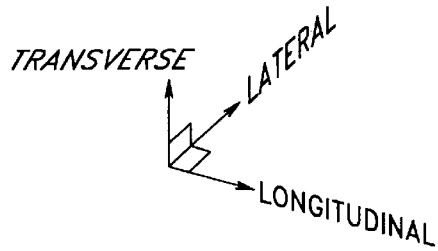

CUTTING DEVICE FOR ELONGATED MATERIALS

BACKGROUND OF THE INVENTION

1. Field of the Invention

The present invention relates in general to a cutting device for elongated materials and, more particularly, to a portable cutting device that attaches to a sewing machine for cutting thread, shoulder tape and the like.

2. Description of the Related Art

Materials used in the manufacture of clothing, such as cotton, polyester and rayon are typically coupled by thread to form a seam. Thread is also used for other purposes such as decoration, labeling and the like. In some textile applications, such as the manufacture of shirts, pants and jackets, shoulder tape extends along a seam to provide reinforcement, flexibility and/or discreteness to the seam. Shoulder tape may be adhesive or nonadhesive and has a typical width of about 5–15 mm and thickness of about 1–3 mm.

Thread and shoulder tape are typically provided in spools of about 25–1,000 yards. Because only a portion of the thread or shoulder tape stored on the spool is required for a particular use, the material must be separated from the spool. When separating the material from the spool, speed, accuracy, safety and cost are important considerations.

One way of separating the material from the spool involves manually cutting the thread with a knife or scissors. However, this procedure takes a significant amount of time and is therefore disadvantageous in commercial clothing manufacturing operations. Another way of separating the material involves an automated knife or scissors. However, automated scissors tend to be sensitive to wear, among other disadvantages, and also tend to be unsafe.

For example, U.S. Pat. No. 4,130,038 issued to Zehnder apparently discloses an automated knife and thread parting device for textile machines. The device has a fixed separating member and a cutting member. The fixed separating member comprises two mutually parallel and mutually spaced thread guide plates. The cutting member comprises a U-shaped thread tensioning bow with spring clamping shanks. A blade is arranged on the cutting member between and parallel to the spring clamping shanks. Although this configuration provides a device that can separate thread, it has significant drawbacks that include: creating a significant likelihood that an operator's finger may be accidentally caught within the device and cut, as well as causing slippage of the thread during the cutting sequence which results in an inaccurate lengthwise cut. The latter shortcoming is particularly evident when used to cut thicker, wider nonthread materials such as shoulder tape.

There is thus a need for a cutting device for elongated materials that improves the speed, accuracy, safety and cost associated with the devices disclosed in the prior art. There is also a need for a cutting device that easily and accurately cuts a variety of elongated material, to include thread and shoulder tape.

SUMMARY OF THE INVENTION

The present invention provides a cutting device for elongated materials comprising a first block or ram, and a second block or receptacle. The ram has a channel that extends along its longitudinal length, the channel is sized and configured to accept at least a portion of a cutting blade. The receptacle has a hollow that is sized and configured to accept at least a portion of the ram. The blade is arranged within the hollow and extends from the receptacle into the hollow and toward the ram. The blade is advantageously recessed within the hollow.

In one embodiment, the ram is moveable between a retracted position, in which the ram is separated from the receptacle, and an extended position, in which at least a portion of the ram is housed within the receptacle. By this configuration, elongated material may be placed between the receptacle and ram and then the ram can move from the retracted position to the extended position, whereby a portion of the elongated material is captured within the channel and cut by the blade.

One aspect of the invention involves a cutting device for elongated materials having a safety feature to inhibit the cutting device from accidentally cutting a person's finger. The cutting device comprises a first block defining a channel within at least a portion of the first block, the first block being moveable between a first position and a second position. A second block defines a hollow within at least a portion of the second block, the hollow sized and configured to accept at least a portion of the first block when the first block is in the second position. The cutting device advantageously has a cutting blade recessed within the second block so as to inhibit contact with a person's finger if the person's finger is placed between the first block and the second block, at least a portion of the cutting blade capable of fitting within the channel of the first block.

Another aspect of the invention involves a device that attaches to a sewing machine for cutting elongated materials, comprising a hydraulic drive attached to the sewing machine and moveable between a retracted position and an extended position; and a ram connected to the drive, the ram having a channel within at least a portion of the ram that extends along an outlet to assist in removing build-up of excess material that has been cut by the device; and a receptacle attached to the sewing machine, the receptacle having a hollow within at least a portion of the receptacle that accepts at least a portion of the ram when the ram is in the extended position and a blade recessed within the receptacle.

Yet another aspect of the invention involves a method for filing materials to form a hem comprising the steps of: interposing the material between a ram and a first recess; moving at least one of the ram and first recess to force the material into the first recess; urging the material against a cutting blade in the first recess; and moving the material and cutting blade into a second recess located in the ram to cut the material.

The cutting device of the present invention thus provides a fast and inexpensive way for separating a variety of elongated materials, in part because of the cutting blade. The device also provides accurate cutting of elongated materials by inhibiting movement of the material during the cutting sequence, in part because of the arrangement of the channel walls of the ram and the channel walls of the receptacle. The device further provides for operator safety by using an unexposed blade recessed within a relatively narrow hollow. The device is also long-lasting since the recessed blade less exposed and therefore a large number of cuts may be made before the blade dulls.

Further aspects, features and advantages of the present invention will become apparent from the drawings and detailed description of the preferred embodiments that follow.

BRIEF DESCRIPTION OF THE DRAWINGS

The above-mentioned and other aspects, features and advantages of the invention will now be addressed with reference to the drawings of preferred embodiments of the present cutting device. The illustrated embodiments of the cutting device are intended to illustrate, but not limit the concepts of the invention. The drawings contain the following figures, in which like numbers refer to like parts throughout the description and drawings and wherein:

FIG. 1 is a perspective view of a preferred embodiment of the cutting device in accordance with the present invention attached to a conventional industrial sewing machine, illustrating a general orientation of the cutting device and elongated material with respect to the sewing machine.

DETAILED DESCRIPTION OF THE PREFERRED EMBODIMENTS

Figure 2:
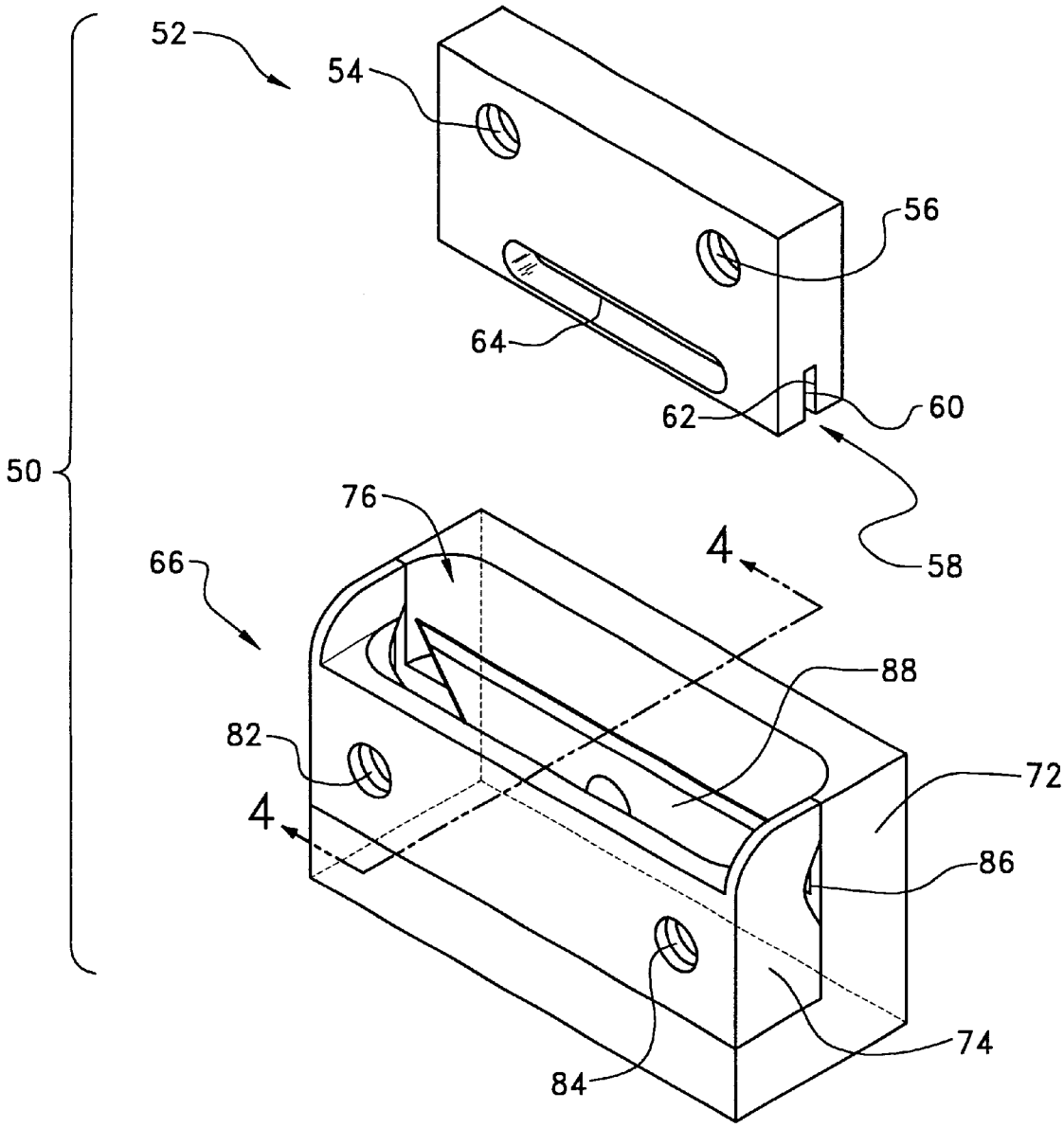
FIG. 2 is a detail perspective view of the cutting device of FIG. 1, illustrating a first block or ram, and a second block or receptacle.

The cutting device described herein employs several basic concepts. For example, one concept relates to a second block or receptacle having a hollow that is sized and configured to accept at least a portion of a first block or ram, and wherein the ram, in turn, has a channel sized and configured to accept at least a portion of a cutting blade disposed within the hollow. Another concept used in the invention relates to a cutting blade recessed within a hollow of a block to inhibit the sewing machine operator from being accidentally cut by the blade. Yet another concept used in the invention relates to an outlet in a block to assist in removing build-up of extraneous material within the block.

To assist in the description of the components and operation of the cutting device 50, the following coordinate terms are used. Referring to FIG. 1, a "longitudinal axis" extends along the length of the sewing machine bed 12, from a distal end 11 to a proximal end 13. A "lateral axis" is generally normal to the longitudinal axis and extends along the width of the sewing machine bed 12. A "transverse axis" is generally normal to both the longitudinal and lateral axes and extends along the vertical height of the sewing machine 10. In addition, as used herein, the "longitudinal direction" refers to a direction substantially parallel to the longitudinal axis; the "lateral direction" refers to a direction substantially parallel to the lateral axis; and the "transverse direction" refers to a direction substantially parallel to the transverse axis. As shown in FIG. 1, for most sewing machines the longitudinal and lateral axis lie in a generally horizontal plane, and the transverse axis is the vertical axis. Also, the terms "proximal" and "distal," which are used to describe the present cutting device 50, are used in relation to the sewing needle 16. Thus, proximal refers to a location closer to the sewing needle and distal refers to a location farther from the sewing needle.

An overview of the cutting device 50 is provided, followed by a more detailed explanation. Referring to FIGS. 1 and 2, a conventional sewing machine 10 has a sewing bed 12, sewing head 14 and sewing needle 16. Elongated material 18, such as thread, shoulder tape and the like extends from a storage location, such as a spool 19, laterally across the cutting device 50.

The cutting device 50 comprises a first block or ram 52, and a second block or recptacle 66. The ram 52 has a channel 58 that extends along its longitudinal length. The channel 58 is sized and configured to accept at least a portion of a cutting blade 88. The receptacle 66 has a hollow 76 sized and configured to accept at least a portion of the ram 52. The blade 88 is arranged within the hollow 76 and extends from the receptacle 66 into the hollow 76 and toward the ram 52. The blade 88 is advantageously recessed within the hollow 76. As illustrated, the blade 88 is vertically oriented within the recess 76 formed in receptacle 66 and aligned to fit in the channel 58.

In one embodiment, the ram 52 is attached to the sewing machine 19 by a coupler 30 and the receptacle 66 is directly attached to the sewing machine 10. Although the ram 52 is shown above the receptacle 66, these elements may be flipped or reversed so that the receptacle 66 is above the ram 52, as will be understood by one skilled in the art. The ram 52 is moveable between a retracted position, in which the ram 52 is separated from the receptacle 66, and an extended position, in which at least a portion of the ram 52 is housed within the receptacle 66. By this configuration, elongated material 18 may be placed between the receptacle 66 and ram 52 and then the ram 52 can move from the retracted position to the extended position, whereby a portion of the elongated material 18 is captured between the receptacle 66 and ram 52, and cut by the blade 88 as the blade 88 enters the slot 58 in the ram.

COMPONENTS

FIG. 1 shows a drive 20 removably attached to the sewing machine 10. The illustrated drive 20 includes an upper element 22 that hydraulically directs a lower element 24. One such drive 20 is commercially available from SMC pneumatics of Malaysia as part number CXSM20–25. However, a variety of other suitable drives can be used to direct the upper element 22, as will be understood by one skilled in the art. The drive 20 can be attached to the sewing machine 10 by any of a variety of suitable means such as threaded fasteners, clamps, clips, adhesives, velcro, magnets, friction locks and the like. The illustrated embodiment depicts a pair of screws 26, 28 used for this purpose. The drive 20, alternatively, may be permanently affixed to the sewing machine 10 by suitable means such as bolting, soldering or adhesives. Permanent affixation is preferred if the same sewing machine 10 and/or elongated material 18 is used with the cutting device 50 for prolonged periods of time, because, once properly set up, subsequent adjustment is not needed. Further, the drive 20 elements may be flipped, that is, the upper element 22 can extend from the sewing bed 12 and move transversely toward the receptacle 66 that is positioned above the upper element 22.

A coupler 30 having a generally L-shaped bracket 32 and an extension 34 interconnects the ram 52 of the cutting device 50 to the drive 20. However, the coupler 30 need not be used and the cutting device 50 may be attached directly to the drive 20. Also, if used, coupler 30 can be formed in unity with the drive 20.

The drive 20 and coupler 30 (if used) advantageously provide for adjustment of the cutting device 50 relative to the sewing machine 10 in the longitudinal, lateral and transverse directions. This variable adjustment allows the cutting device 50 to quickly and easily adjust to different sewing machines 10 and different types of elongated material 18.

The illustrated embodiment shows adjustment of the cutting device ram in the transverse direction by the screws 26, 28 that interconnect the upper element 22 of the drive 20 with the sewing machine 10. The screws 26, 28 can be loosened and moved along respective elongated slots or tracks 36, 38 that extend through the upper element 22 in the transverse direction. Subsequent tightening of the screws 26, 28 into the sewing machine 10 secures the drive 20, and thus the ram 52, in a particular transverse position. Longitudinal adjustment of the ram 52 can be achieved in a similar manner. That is, a pair of screws 40, 42 are arranged on the underside of the coupler 30 and pass through a respective pair of elongated slots or tracks that extend through the coupler 30 in the longitudinal direction (not shown). The screws 40, 42 are secured within the lower element 24 of the drive 20. Likewise, these screws 40, 42 can be loosened, adjusted along the longitudinal length of the track and then tightened to retain a particular longitudinal position. Lateral adjustment of the ram 52 is shown by another pair of screws 44, 46 extending laterally from the bracket extension 34. These screws 44, 46 pass through the bracket extension 34, through the ram 52 and into the opposing end L-shaped (in cross-section) bracket 32. Rotation of the screws 44, 46 causes the extension 34 to laterally advance toward (or recede from) the L-shaped bracket 32, thereby adjusting the ram 52 in the lateral direction.

Although the above-described adjustment system uses three pairs of screws, other screw sets may be used, such as three individual screws. Also, devices other than screws may be used, such as cams, pins, clamps or clips. Further, a wing nut such as 44, 46 or other suitable device can be used to provide hand adjustment of the screws. A similar coupler may also be used to provide for variable adjustment of the position of the receptacle 66, which is shown attached to the sewing machine 10 by a pair of screws 68, 70. Moreover, a variety of other adjustment systems can be used to adjust the position of the cutting device 50 relative to the sewing needle 16 in the longitudinal, lateral and transverse directions, as will be understood by one skilled in the art. For example, the drive 20, ram 52 and/or receptacle 66 may include velcro or be magnetic for selective and removable positioning.

The drive 20 and optional bracket 30 thus advantageously provide removable attachment of the cutting device 50 to the sewing machine 16 and multi-axis adjustment of the cutting device 50 relative to the sewing machine 10. The drive 20, coupler 30 and cutting device 50 elements are advantageously portable and easily transported for use with industrial and private sewing machines.

Figures 3A, 3B:
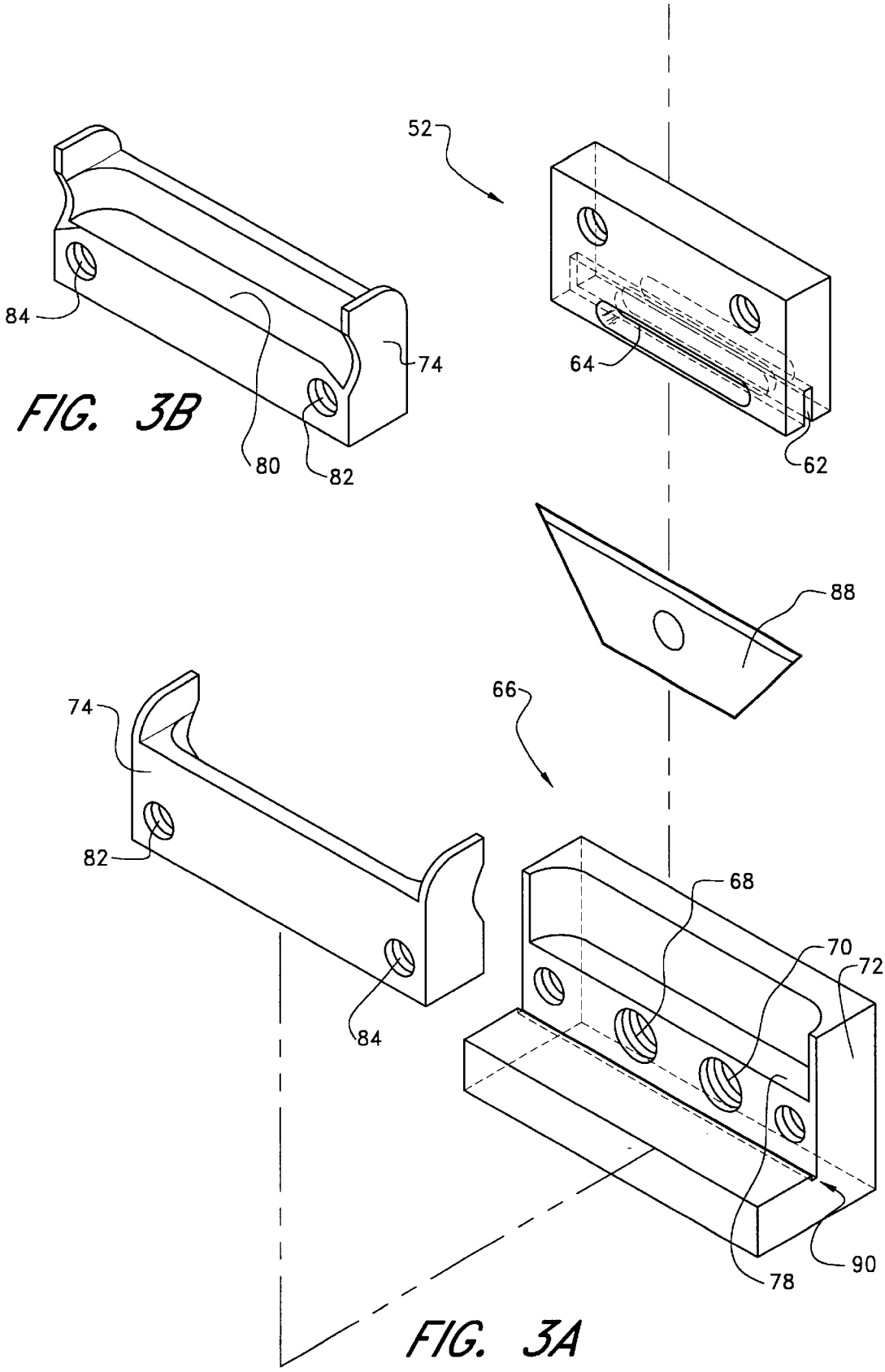
FIG. 3A is an exploded detail perspective view of the cutting device of FIG. 1, illustrating the interrelationship among several of the elements of the cutting device.
FIG. 3B is perspective view of a second portion of the receptacle, illustrating the interior of the second portion not shown in FIG. 3A.

Referring to FIGS. 2 and 3, the cutting device 50 comprises a first block or ram 52. The first block 52 includes a pair of screw holes 54, 56 for attachment to the coupler 30, as described above. However, the screw holes 54, 56 can be obviated by attaching the ram 52 to the coupler 30 (or directly to the drive 20) by a variety of other suitable structures, such as clamps, clips, adhesives, velcro, magnets, friction locks and the like.

The illustrated ram 52 has a generally parallelepiped configuration, and more particularly, a generally rectangular configuration. However, the ram 52 may be configured in a wide variety of other three dimensional shapes such as discuss, ellipsoidal, cubical, capsular, spherical, pyramidal, oblong, curvilinear, portions thereof and the like. The particular dimensions of the ram 52 can vary greatly. In an exemplary application with the illustrated conventional industrial sewing machine, the ram 52 has a longitudinal length of about 5–100 mm and preferably about 25 mm; a lateral width of about 1–20 mm and preferably about 4 mm; and a transverse height of about 5–50 mm and preferably about 14 mm. The ram 52 may be constructed of a variety of materials such as metal, plastics, ceramic and composites. The ram 52 shown in the exemplary application is constructed of metal, and more particularly steel, due to its strength, low cost and light weight.

A channel 58 is disposed within the ram 52 and extends along the longitudinal length of the ram 52. Preferably, the channel 58 runs the entire longitudinal length of the ram 52 for ease of manufacture. The channel 58 is sized and configured to accept at least a portion of the cutting blade 88. A close-fit relationship advantageously exists among the channel walls 60, 62, cutting blade 88 and elongated material 18 so that the blade 88 securely cuts the elongated material 18 without significant movement of the material 18 with respect to the blade 88, as discussed below. The particular dimensions of the channel 58 can vary greatly. In the exemplary application with the illustrated conventional industrial sewing machine 10, the longitudinal length is commensurate with the longitudinal length of the ram 52; the lateral width is about 0.1–5 mm and preferably about 1 mm; and a transverse height is about 0.5–10 mm and preferably about 2 mm.

An outlet 64 extends laterally from the channel 58 and provides an avenue of egress for extraneous materials, such as small pieces of elongated material 18 and lint, which tend to collect within the channel 58 during operation of the cutting device 50. If these extraneous materials are not removed from the channel 58, they tend to build up and wedge the channel 58 apart, which is disadvantageous to prolonged use of the device 50. Operation of the cutting device tends to automatically drive the extraneous materials out of the channel 58 via the outlet 64, however, the extraneous materials may also be manually extracted from the channel by a brush, air pressure or other suitable means. The outlet 64 need not be configured as a single elongated opening, rather, the outlet 64 may comprise one or more openings of any suitable size and shape to accomplish its intended purpose.

Still referring to FIGS. 2 and 3, the cutting device 50 also includes a support containing a recess, shown as second block or receptacle 66 containing recess 76. The second block 66 has a pair of screw holes 68, 70 for attachment to the sewing machine 10, as described above. However, the screw holes 68, 70 can be obviated by attaching the receptacle 66 to the sewing machine by a variety of other suitable structures, such as clamps, clips, adhesives, velcro, magnets, friction locks and the like, or by a coupler as noted above.

In one embodiment, the receptacle 66 has a first portion 72 that joins with a second portion 74 to define a generally U-shaped recess or hollow 76. The first portion 72 is illustrated in a generally L-shaped configuration having a step or ledge 78. The second portion 74 is illustrated in a generally elongated configuration and also has a step or ledge 80. The second portion 74 advantageously sits atop a section of the first portion 72 and is secured to the first portion 72 by a pair of screws that extend through screw holes 82, 84. However, the first and second portions 72, 74 may be secured by a variety of other fasteners, as will be understood by one skilled in the art. Moreover, the first and second portions 72, 74 may be secured without any additional fastening structures, such as by respectively forming a keyway groove and a key that interlock. Also, the receptacle 66 may be unitary, as described in connection with another preferred embodiment of the cutting device 50 illustrated in FIGS. 8–12.

The receptacle 66 defines a generally U-shaped hollow 76, however, the hollow 76 may be configured in a wide variety of other suitable shapes to accept at least a portion of the ram 52. Preferably, the hollow 76 can accept the entire longitudinal length and transverse width of the ram 52. The particular dimensions of the hollow 76, however, can vary greatly. In the exemplary application with the conventional industrial sewing machine 10, the hollow 76 has a longitudinal length of about 5–100 mm and preferably about 35 mm; a lateral width of about 2–50 mm and preferably about 9 mm; an upper transverse height of about 2–50 mm and preferably about 7 mm and a lower transverse height of about 2–50 mm and preferably about 5 mm. Differences in the transverse height allows an operator to more easily observe cutting device operations as well as assists in providing egress for the extraneous materials.

The receptacle 66 may also include one or more openings 86 to further assist egress of the extraneous materials.

The receptacle 66 may be constructed of a variety of materials such as metal, plastics, ceramic and composites. The illustrated receptacle is constructed of metal and more particularly steel due to its strength, low cost and light weight.

Still referring to FIGS. 2 and 3, the hollow 76 is sized and configured to accept and retain cutting blade 88. Advantageously, the cutting blade 88 is recessed within the hollow, as explained below. Although any of a variety of blades may be used, the illustrated embodiment shows a conventional razor blade. A razor blade is preferred due its low cost, thinness, strength, durability and sharp edge. In one embodiment, the hollow 76 accepts the blade by the operator initially detaching the first and second portions 72, 74 of the receptacle 66, seating the blade 88 on the first portion 72 of the receptacle 66 and then replacing the second portion 74 of the receptacle 66 to sandwich the blade 88 between the portions 72, 74 and form the U-shaped receptacle 66.

ASSEMBLY

Referring back to FIG. 1, in an exemplary assembly of the cutting device 50, the ram 52 and the first portion 72 of the receptacle 66 are attached to the sewing machine 10, as described above.

The cutting blade 50 is then seated on the first portion 72 of the receptacle 66, as explained above. The first portion 72 may include a recess 90 (FIG. 3A) to receive a noncutting portion of the blade 88 to assist in seating the blade 88. The first portion 72 and/or blade 88 may also be magnetized to assist in seating the blade 88. Other means to assist in seating the blade 88 onto the first portion 72 may also be used, as will be understood by one skilled in the art. The second portion 74 of the receptacle 66 is then attached to the first portion 72 by screws 68, 70 that sandwich the blade 88 between the portions 72, 74 and within the hollow 76, as explained above. The cutting blade 88 advantageously transversely extends from the receptacle 66 into the hollow 76 but not above the hollow 76. This recessed configuration provides a safety feature where, if an operator's finger is accidentally placed over the receptacle 66 and the ram 52 then pushes on the operator's finger, the relatively small lateral width of the hollow 76 as above-described in the preferred dimensions and the relatively significant recess of the blade 88, prevents or inhibits contact between the blade 88 and operator's finger. The blade is advantageously recessed about 1–40 mm from the uppermost portion of the receptacle 66 and more preferably about 2 mm.

The ram 52 and/or receptacle 66 is then adjusted in the longitudinal, lateral and transverse directions so that at least a portion of the ram 52 fits within the hollow 76 of the receptacle 66, and at least a portion of the cutting blade 88 fits within the channel 76. Preferably, the entire longitudinal length and transverse width of the ram 52 fits within the hollow 76 and the ram 52 does not contact the housing walls 60, 62. Also, the entire longitudinal length and transverse width of the blade 88 preferably fits within the channel 58 and does not contact the walls of the channel 58. More preferably, the ram 52 is centered within the hollow 76 and the cutting blade 88 is centered within the channel 58. Avoidance of contact among the ram 52, receptacle 66 and blade 88 is preferred so that these elements are not deformed by contact amongst each other. However, close tolerances among these elements are preferred to assist in providing an accurate cut, as explained below.

OPERATION

FIGS. 4–7 show an exemplary cutting device operation after the cutting device 50 is assembled as described above.

Figure 4:
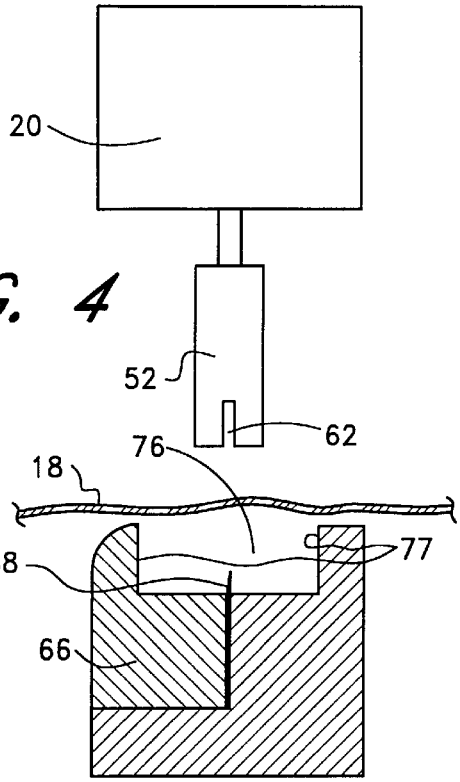
FIG. 4 is a partially sectioned, schematic side view of the cutting device of FIG. 1, illustrating a portion of a cutting sequence wherein the ram is in a retracted position, and the elongated material is arranged between the receptacle and ram.

FIG. 4 shows elongated material 18 laterally extending across the sewing machine bed (not shown) and between the receptacle 66 and ram 52. The ram 52 is shown in a retracted position, wherein the ram 52 is separate from the receptacle 66 and closer to the drive 20. The cutting blade 88 transversely extends from the receptacle 66 and into the hollow 76 but preferably not above the hollow 76.

Figure 5:
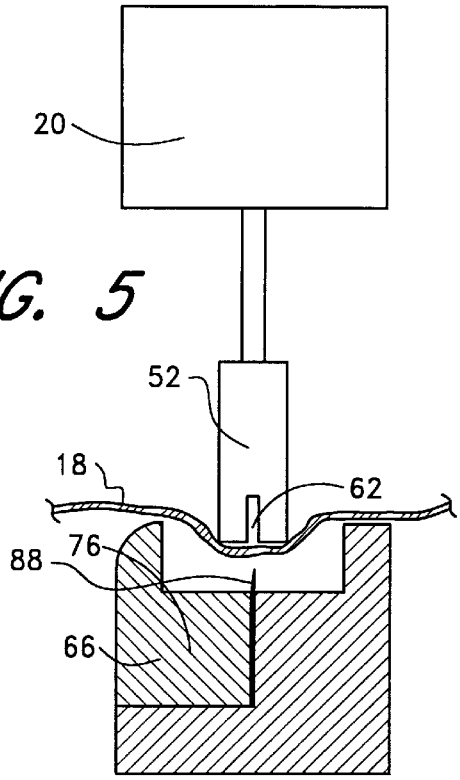
FIG. 5 is a partially sectioned, schematic side view of the cutting device of FIG. 1, illustrating another portion of the cutting sequence wherein the ram is moved from the retracted position toward the receptacle, and the ram contacts the elongated material to urge the material toward a cutting blade.

FIG. 5 shows the ram 52 transversely moved from the fully retracted position toward the receptacle 66. A portion of the ram 52 extends into the hollow 76 and urges a portion of the elongated material 18 into the hollow 76. Tolerances between the exterior of the ram 52 and walls of the hollow 76 can range from about 0.5–20 mm, depending on the type of elongated material 18 used. In the illustrated exemplary use with shoulder tape about 0.5–1.5 mm thick, preferably tolerances of about 4–6 mm are used.

Figure 6:
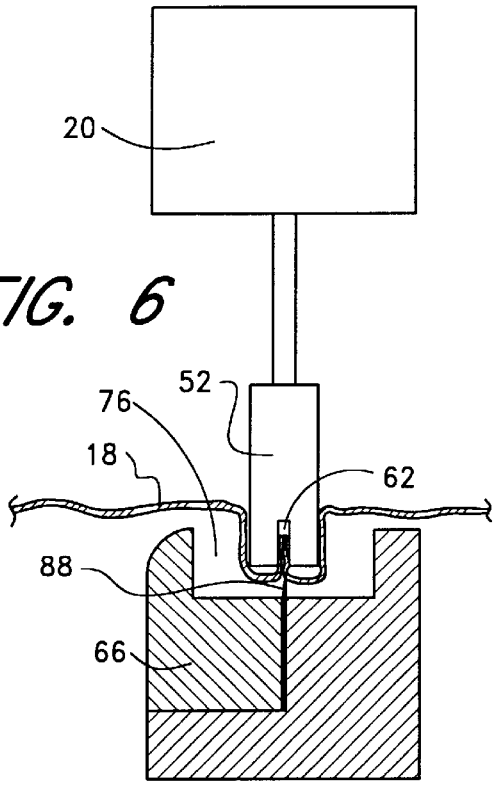
FIG. 6 is a partially sectioned, schematic side view of the cutting device of FIG. 1, illustrating another portion of the cutting sequence wherein of the ram is in an extended position, and a portion of the elongated material and cutting blade are captured within a channel of the ram.

FIG. 6 shows the ram 52 in an extended position. When in the extended position, a portion of the elongated material 18 and the blade 88 extends into and is captured within the channel 58 on opposing sides of the blade 88. The close tolerances between the exterior sides of the blade 88 and the channel walls 60, 62 provide for direct pressure and friction that acts on the elongated material 18 within the channel 62 and causes the portion of the elongated material 18 that lies within the channel 62 to become taut. Tolerances can range from about 1–10 mm, depending on the type of elongated material 18 used. In the exemplary use, preferable tolerances of about 4–6 mm are used. As the ram 52 continues toward the cutting blade 88, the cutting blade 88 contacts the taut and secure elongated material 18 and cuts the elongated material 18 without significant longitudinal movement of the elongated material 18. Thus, the tautness provides for an accurate cut of the elongated material 18. After the ram 52 reaches the fully extended position and the elongated material 18 has been severed, the ram 52 commences its return to the retracted position.

Figure 7:
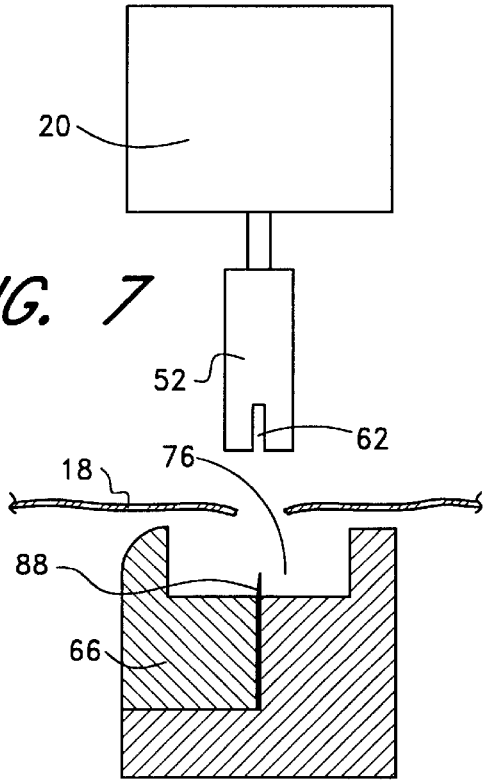
FIG. 7 is a partially sectioned, schematic side view of the cutting device of FIG. 1, illustrating another portion of the cutting sequence wherein the ram returns to the retracted position and the elongated material is separated.

FIG. 7 shows the ram 52 returned to the fully retracted position and the elongated material 18 separated. After this step, the separated elongated material 18 may be removed from the cutting device 50 and sewing machine 10. Additional elongated material 18 may then be arranged between the receptacle 66 and ram 52, and the above-described cutting process repeated.

ALTERNATIVE EMBODIMENTS

A cutting device 50*a* in accordance with another preferred embodiment of the invention is illustrated in FIGS. 1–7. The chief differences between this embodiment and the previous embodiment is the receptacle configuration 66*a*, the manner in which the receptacle 66*a* is attached to the sewing machine 10*a*, the transverse depth of the channel 52 and the cutting operation. Accordingly, the above description applies equally to the embodiment of FIGS. 8–12, unless otherwise indicated. In addition, like reference numerals are used to indicate like features to the two embodiments, with the letter designation "a" added as a suffix to refer to particular features of the present embodiment.

The concepts used in the cutting device 50*a* described herein are similar to the concepts of the previous embodiment. However, the particular structure and arrangement thereof used to accomplish these principles differs, as described below. Like the previous embodiment, the cutting device 50*a* comprises a first block or ram 52*a* arranged transversely above a second block or receptacle 66*a*, however, this arrangement may be reversed.

Figure 8:
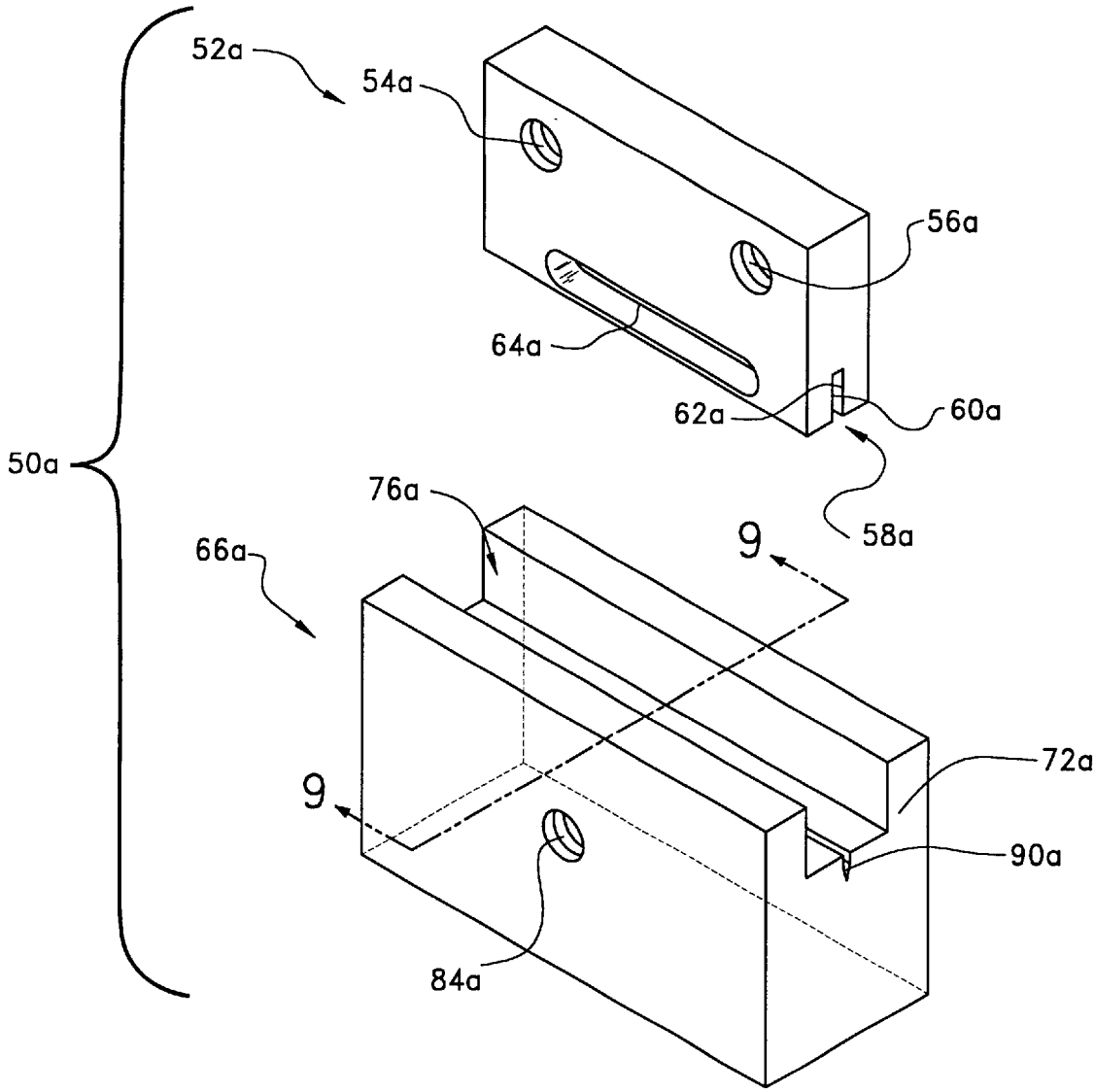
FIG. 8 is a partially sectioned, detail perspective view of another embodiment of the cutting device of the present invention, illustrating a first block or ram, and a second block or receptacle.

As best seen in FIG. 8, the receptacle 66*a* is configured as a one-piece unitary member. The hollow 76*a* is substantially U-shaped in cross-section and extends the entire longitudinal length of the receptacle 66*a*. The hollow 76*a* has no openings that could assist in egress of the extraneous material. This embodiment provides a simply configured receptacle 66*a* that can be manufactured at lost cost.

The receptacle 66*a* has a recess 90*a* within the bottom of the hollow 76*a* in which the blade 88*a* is seated. Preferably the recess 90*a* extends the entire length of the hollow 76*a* for ease of manufacture. The recess 90*a* has a lateral width slightly larger than the lateral width of the blade 88 and a transverse depth sufficiently deep so that when the blade 88 is placed in the recess 90*a*, the blade does not move. Suitable recess 90*a* depths can be about 1–20 mm and preferably about 5–10 mm. The illustrated recess also has a slight angle (e.g. about 1°–20°) that decreases the lateral width of the recess 90*a* as measured into the depth of the recess 90*a* to assist in securing the noncutting portion of the blade 88*a* into the recess 90*a*. The blade 88 can be placed in the recess 90*a* either by hand or with the assistance of a needle nose plier or other tool. Supplemental means, such as adhesives, or magnetic forces may also be used to secure the noncutting portion of the blade 88*a* within the recess 90*a*. That is, a small amount of weak glue such as ELMER's glue can be placed on the noncutting edge of the blade 88*a* before the blade 88*a* is placed in the recess 90*a* to secure the blade 88*a* within the recess 90*a*. A weak glue is preferred because it is inexpensive, suitably secures the blade 88*a*, and is easily removed by a needle-nose pliers or other tool.

The receptacle 66*a* has a hole 84*a* that allows the receptacle 66*a* to be attached to the sewing machine 10 by a single screw that has a wing nut formed thereon (not shown).

This allows for quick attachment and detachment of the receptacle 66*a* to the sewing machine 10 (FIG. 1). Similar screws may be used to attach the ram 52 and drive 20 to the sewing machine 10 for this quick attachment purpose.

FIGS. 9–12 illustrate a close-fit relationship between the blade 88*a*, exterior sides of the ram 52*a* and channel walls 60*a*, 62*a*, that achieves the same function of accurately cutting the elongated material 18*a*, but through a different design.

Figure 9:
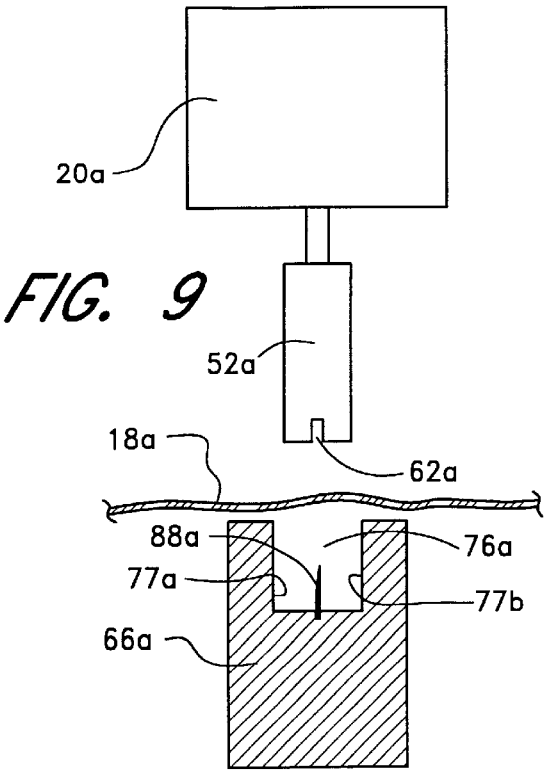
FIG. 9 is a partially sectioned, schematic side view of the cutting device of FIG. 8, illustrating a portion of a cutting sequence wherein the ram is in the retracted position, and the elongated material is arranged between the receptacle and ram.

FIG. 9 is similar to FIG. 4 and shows elongated material 18*a* laterally extending across the sewing machine bed (not shown) and between the receptacle 66*a* and ram 52*a*. The ram 52*a* is in the retracted position. The cutting blade 88*a* transversely extends from the receptacle 66*a* and into the hollow 76*a* but preferably not above the hollow 76*a*.

Figure 10:
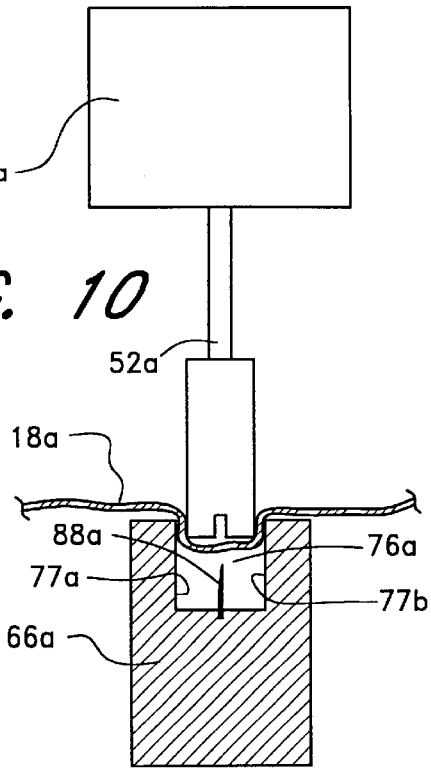
FIG. 10 is a partially sectioned, schematic side view of the cutting device of FIG. 8, illustrating another portion of the cutting sequence wherein the ram is moved from the retracted position toward the receptacle, and the ram contacts the elongated material to urge the material toward a cutting blade.

FIG. 10 is generally similar to FIG. 4 and shows the ram 52*a* transversely moved from the fully retracted position toward the receptacle 66*a*. A portion of the ram 52*a* extends into the hollow 76*a* and urges a portion of the elongated material 18*a* into the hollow 76*a*. The tolerances between the exterior sides of the ram 52*a* and the walls 77*a*, 77*b* of the hollow 76*a* are tighter than the previous embodiment. These tighter tolerances provide for direct pressure and friction which acts on the elongated material 18*a* and causes the portion of the elongated material 18*a* that lies across the hollow 76 to become taut. The ram 52 cooperates with the walls 77 or at least the corners of the recess 76*a*, to keep the material 18*a* in tension. Depending on the elongated material 18*a* used, the tolerances can range from about 0.1–5 mm. In the exemplary use, preferable tolerances of about 1–2 mm are used. The space between each of the walls 77 and the adjacent sides of the ram 52*a* is preferably slightly larger than the thickness of material 18, but not more than about 2–4 times that thickness. As the ram 52*a* continues toward the cutting blade 88*a*, the tautness of the elongated material 18*a* is increased so that when the blade 88*a* contacts the elongated material 18*a*, the elongated material 18*a* nears its breaking point. The elongated material 88*a* may also stretch or slightly slip to avoid breaking. The transverse depth of the channel 52*a* is about half the transverse depth of the previous embodiment for ease of manufacture since there is no need for an appreciable depth as the elongated material 18 does not appreciably enter into the channel 52*a*.

Figure 11:
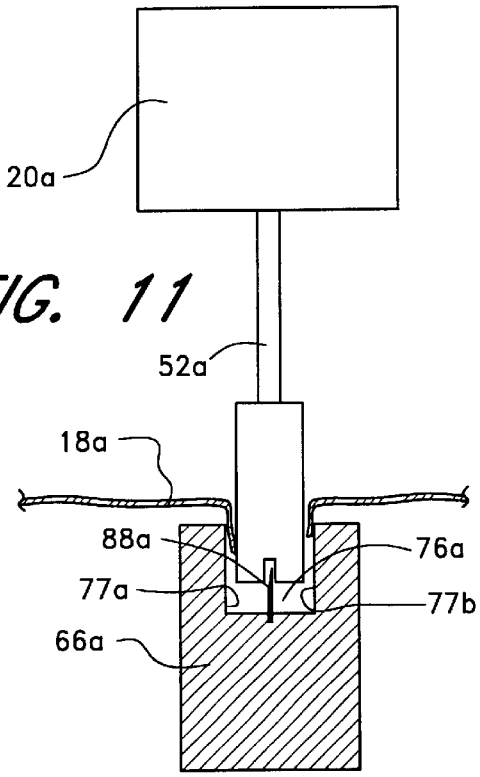
FIG. 11 is a partially sectioned, schematic side view of the cutting device of FIG. 8, illustrating another portion of the cutting sequence wherein of the ram is in the extended position, and a portion of the elongated material and cutting blade cooperate the cut the material.

FIG. 11 is generally similar to FIG. 6 and shows the ram 52*a* in the extended position. The tautness of the elongated material 18*a* prevents the elongated material 18*a* from appreciably extending into and becoming captured within the channel 58*a*. The blade 88*a* then cuts the elongated material 18*a* and continues into the channel 58*a*.

Thus, the tautness provides for an accurate cut of the elongated material 18*a*. The tolerances between the channel walls 60*a*, 62*a* and blade 88*a* are less than the previous embodiment because there is no need to generate forces and the additional tolerances assist in assuring the blade 88*a* does not contact the channel walls 60*a*, 62*a*. Depending on the elongated material 18*a* used, the tolerances can range from about 0.5–10 mm. In the exemplary use, preferable tolerances of about 1–4 mm are used. After the ram 52*a* reaches the fully extended position wherein the elongated material 18*a* has been severed, the ram 52*a* commences its return to the retracted position.

Figure 12:
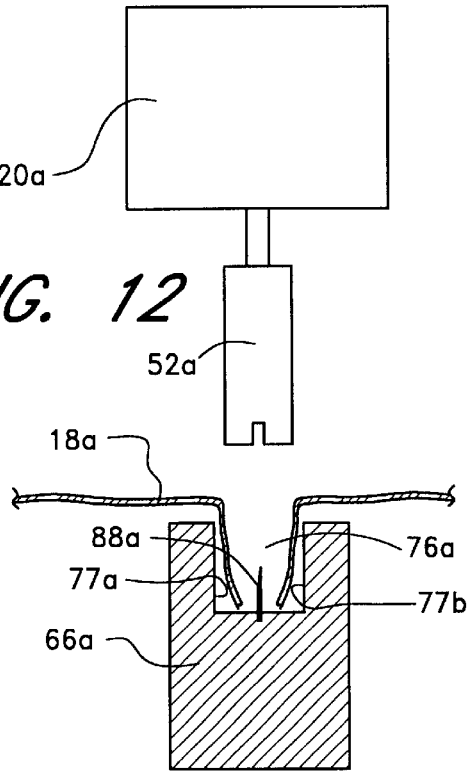
FIG. 12 is a partially sectioned, schematic side view of the cutting device of FIG. 8, illustrating another portion of the cutting sequence wherein the ram returns to the retracted position and the elongated material is separated.

FIG. 12 is similar to FIG. 7 shows the ram 52*a* returned to the fully retracted position and the elongated material 18*a* separated. After this step, the separated elongated material 18*a* may be removed from the cutting device 50*a* and sewing machine 10*a*. Additional elongated material 18*a* may then be arranged between the receptacle 66*a* and ram 52*a*, and the above-described cutting process repeated.

There is thus provided a cutting blade 88, 88*a*, placed in a recess 76, 76*a* of sufficient depth and width as to reduce the likelihood that a person's finger will be cut by the blade. The walls 77 forming the recess 76 are close enough and high enough to inhibit a person's finger from entering recess 76 and being cut by the blade 88, 88*a* extending into that recess.

There is further provided a ram 52, 52*a* located and sized to fit within recess 76, 76*a* and to urge material 18 into the recess. A second recess or channel 62, 62*a* formed in the ram 52, 52*a* and located to receive the cutting edge of blade 88. The second recess or channel 62, 62*a* is sized relative to blade 88 and the thickness of material 18 to restrain movement of the material 18 relative to the blade 88 so the blade cuts the material as the blade pushes material 18 into the channel 62, 62*a*.

There is further advantageously provided ram 52, 52*a* that is sized relative to the recess or hollow 76, 76*a* and the thickness of the material 18 so the movement of the material is restrained as the ram pushes the material into the hollow, making it easier for the blade 88 to cut the material.

The above embodiments are described with the ram 52, 52*a* moving relative to a stationary recess 88, however, the recess 76 and blade 88 could move relative to a stationary ram. Of course, both the ram 52, 52*a* and blade 88 could move relative to a stationary sewing bed 12. Similarly, although the cutting device is illustrated as being located on one lateral side of the sewing bed 12, it could be located on the other lateral side of the sewing bet 12 or at the proximal front end of the sewing bed 12. Of course, the cutting device could be arranged in a variety of other locations although it is preferred that the blade 88 initially contact the material 12 at a location generally planar to the sewing bed 12.

The cutting device of the present invention is disclosed in the context of an exemplary device that can be attached to a sewing machine to cut a variety of elongated materials, such as thread and shoulder tape. The principles of the present invention, however, are not limited to use with sewing machines, or thread and shoulder tape. Instead, it will be understood by one skilled in the art, in light of the present disclosure, that the invention disclosed herein can also be successfully used in connection with other apparatus, such as conveyors and presses. Concomitantly, the device disclosed herein can be used to cut other types of elongated material, such as paper, plastic, rubber and the like. One skilled in the art may also recognize additional applications for the device and concepts disclosed herein. Thus, the illustrations and description of the present invention is merely exemplary of one possible application of the invention.

Although this invention has been described in terms of certain exemplary uses, preferred embodiments and possible modifications thereto, other uses, embodiments and modifications apparent those of ordinary skill in the art are also with the spirit and scope of this invention. It is also understood that various aspects of one embodiment can be interchanged and used with various aspects of another or several embodiments. Accordingly, the scope of the invention is intended to be defined only by the claims that follow.

What is claimed is:

1. A cutting device for elongated materials having a safety feature to inhibit the cutting device from accidentally cutting a person's finger, comprising:

a first block debug a channel within at least a portion of the first block, the first block being moveable between a first position and a second position;

a second block defining a hollow within at least a portion of the second block, the hollow sized and configured to accept at least a portion of the first block when the first block is in the second position; and a cutting blade recessed within the second block and fixed relative to the second block so as to inhibit contact with a person's finger if the person's finger is placed between the first block and the second block, at least a portion of the cutting blade capable of fitting wit the channel of the first block.

2. The cutting device of claim 1, wherein the first block has an outlet configured and located to permit egress material that has been cut by the cutting device.

3. The cutting device of claim 1, wherein the first block has a longitudinal length of about 5–100 mm, a lateral width of about 1–20 mm, and a transverse height of about 5–50 mm.

4. The cutting device of claim 1, wherein the channel of the first block has a longitudinal length of about 5–100 mm, a lateral width of about 0.1–5 mm, and a transverse height of about 0.5–10 mm.

5. The cutting device of claim 1, wherein the second block comprises a first portion that is attachable to a second portion.

6. A cutting device for elongated materials having a safety feature to inhibit the cutting device from accidentally cutting a person's finger, comprising:

a first block defining a channel within at least a portion of the first block, the first block being moveable between a first position and a second position;

a second block defining a hollow within at least a portion of the second block, the hollow sized and configured to accept at least a portion of the first block when the first block is in the second position; and a cutting blade recessed within the second block so as to inhibit contact with a person's finger if the person's finger is placed between the first block and the second block, at least a portion of the cutting blade capable of fitting within the chapel of the fist block, wherein the second block courses a first portion that is attachable to a second portion, and wherein the first portion and the second portion are connected by a pair of screws.

7. The cutting device of claim 5, wherein the first portion of the second block is generally L-shaped in cross-section, and the second portion of the second block is generally elongated, and when the first and second portions are attached the second portion sits atop at least a portion of the first portion to form the second block.

8. The cutting device of claim 1, wherein the second block has a unitary construction.

9. The cutting device of claim 1, wherein the hollow of the second block has a longitudinal length of about 5–100 mm, a lateral width of about 2–50 mm, and a transverse height of about 2–50 mm.

10. The cutting device of claim 1, wherein the blade is a conventional razor blade.

11. The cutting device of claim 10, wherein the blade is recessed about 1–5 mm from the uppermost portion of the second block.

12. The cutting device of claim 10, wherein the first block is sized and configured to accept at least a portion of the blade.

13. A device that attaches to a sewing machine for cutting elongated materials, comprising:

a hydraulic drive attached to the sewing machine and moveable between a retracted position and an extended position;

a ram connected to the drive, the ram having a channel within at least a portion of the ram that extends along an outlet to assist in removing build-up of excess material that has been cut by the device;

a receptacle attached to the sewing machine, the receptacle having a hollow within at least a portion of the receptacle that accepts at least a portion of the ram when the ram is in the extended position and a blade recessed within the receptacle.

14. The device of claim 13, wherein the drive has an upper element attached to the sewing machine and a lower element moveably attached to the upper element.

15. The cutting device of claim 13, wherein the upper element is removably attached to the sewing machine and the lower element is permanently attached to the upper element.

16. The cutting device of claim 13, wherein the location of the ram is adjustable in at least one of three orthogonal axes with respect to the sewing machine.

17. The cutting device of claim 16, wherein a first pair of screws provides for longitudinal adjustment of the ram with respect to the sewing machine, a second pair of screws provides for lateral adjustment of the ram with respect to the sewing machine, and a third pair of screws provides for transverse adjustment of the ram with respect to the sewing machine.

18. The cutting device of claim 17, wherein the second pair of screws incorporate a hand-tightened nut to allow hand tightening of the screws.

19. A sewing machine apparatus, the apparatus comprising:

a ram having a width and having a first recess;

a support having a second recess located so that an elongated sewing machine material may be interposed between the ram and the second recess, the second recess being sized to receive the ram and the material, at least one of the ram and support being movable to selectively engage ram with the second recess; and a cutting blade contained within the second recess, the blade sized and located to fit at least partially within the fist recess when the rain engages the second recess to cut the material in the first recess.

20. An apparatus as defined in claim 19, where the second recess is defined by second walls having a height, the blade not extending out of the second recess beyond the walls, the walls having a height and spacing such that a finger of the operator of the sewing machine does not readily fit into the second recess a distance sufficient for the blade to cut the finger.

21. An apparatus as defined in claim 19, wherein the ram moves relative to the support.

22. An apparatus as defined in claim 19, wherein the support moves relative to the ram.

23. An apparatus as defined in claim 19, wherein the first recess has a width selected relative to the thickness of the material and a thickness of the blade such that the first recess restrains movement of the material to make it easier for the blade to cut the material in the first recess.

24. An apparatus as defined in claim 19, wherein the second recess is sized relative to the ram and the thickness of the material to restrain movement of the material as the ram enters the second recess to make it easier for the blade to cut the material as the blade passes into the first recess.

25. An apparatus as defined in claim 24, wherein the second recess is sized relative to the ram and the thickness of the material to restrain movement of the material as the ram enters the second recess to make it easier for the blade to cut the material as the blade passes into the first recess.

26. An apparatus as defined in claim 19, further comprising a sewing machine to which the ram and the support are attached.

27. An apparatus as defined in claim 19, wherein the sewing machine material is thread.

28. An apparatus as defined in claim 19, wherein the sewing machine material is shoulder tape.

29. A method for cutting a material, the material having a thickness, comprising the steps of;

interposing the meal between a ram and a first recess;

moving at least one of the ram and fist recess to force the material into the first recess;

urging the material against a cutting blade in the fist recess; and moving the material and cutting blade into a second recess located in the ram to cut the material.

30. A method as in claim 29, comprising the further step of restraining movement of material into the first recess to tighten the material and make it easier to cut with the blade.

31. A method as in claim 29, wherein the ram moves relative to a stationary blade.

32. A method as in claim 29, comprising the further step of recessing the height of the blade in the first recess and limiting a size of the recess to hinder a person's finger from entering the first recess an amount sufficient to be cut by the blade.

33. A method as in claim 29, wherein the material is thread.

34. A method as in claim 29, wherein the material is shoulder tape.

35. A cutting device attachable to a sewing machine having a safety feature to inhibit the cutting device from accidentally cutting a person's finger, comprising:

a first block defining a channel extending at least partially along the longitudinal length of the first block;

a second block defining a hollow within at least a portion of the second block, the hollow sized and configured to accept at least a portion of the first block, the second block comprising a first piece that is attachable to a second piece, the first piece of the second block being generally L-shaped in cross section and having a first ledge, the second piece of the second block being generally elongated and hat a second ledge, the second portion sitting atop at least a portion of the first portion to form the second block when the first and second portions are attached, and wherein the first ledge and the second ledge define a bottom surface of the hollow; and a cutting blade recessed within the second block so as to inhibit contact with a person's finger if a person's finger is placed between the first block and the second block, the cutting blade being fixed within the second block between the first piece and the second piece, and wherein the channel is sized and configured to accept at least a portion of the cutting blade;

wherein the first block and the second block are moveable relative to one another to cause the first block to be received within the hollow and the cutting blade to be received within the channel.

36. The cutting device of claim 35, wherein the first block has a generally rectangular configuration.

37. The cutting device of claim 35 wherein the channel extends along the entire longitudinal length of the first block.

38. The cutting device of claim 35, wherein the channel has a lateral width of about 0.1 to 5 mm.

39. The cutting device of claim 35, wherein the channel has a transverse height of about 0.5 to 10 mm.

40. The cutting device of claim 35, wherein the hollow is sized and configured to accept the entire longitudinal length and transverse width of the first block.

41. A cutting device attachable to a sewing machine for cutting an elongated material, comprising:

a generally rectangular upper block having a longitudinal length and a transverse width having a channel formed therein, said upper block being moveable in a vertical direction between a first position and a second position;

a generally rectangular lower block having a generally U-shaped cavity, said cavity being configured to receive the entire longitudinal length and transverse width of said upper block, and further configured to receive at least a partial depth of said upper block; and a cutting blade fixedly recessed within said cavity, at least a portion of said blade capable of fitting within said channel formed in said upper block when said upper block is in said second position.

* * * * *

UNITED STATES PATENT AND TRADEMARK OFFICE

CERTIFICATE OF CORRECTION

PATENT NO. : 6,523,488 B1
DATED : February 25, 2003
INVENTOR(S) : John Y. Lee

It is certified that error appears in the above-identified patent and that said Letters Patent is hereby corrected as shown below:

Column 12,
Line 19, please delete “debug” and insert therefore -- defining --.

Column 14,
Line 34, please delete “meal” and insert therefore -- material --.

Signed and Sealed this

Seventh Day of September, 2004

JON W. DUDAS
*Director of the United States Patent and Trademark Office*